US010364628B2

(12) United States Patent
Bai

(10) Patent No.: US 10,364,628 B2
(45) Date of Patent: Jul. 30, 2019

(54) USE OF PRE-STRESSED STEEL STRAND IN THE PROCEDURE OF MULTI-ANGLE DRILLING CORING

(71) Applicant: Chifeng Hao Feng Drilling Co., Ltd., Chifeng (CN)

(72) Inventor: Ruifeng Bai, Chifeng (CN)

(73) Assignee: CHIFENG HAO FENG DRILLING CO., LTD., Chifeng (CN)

( * ) Notice: Subject to any disclaimer, the term of this patent is extended or adjusted under 35 U.S.C. 154(b) by 0 days.

(21) Appl. No.: 15/521,622

(22) PCT Filed: May 24, 2016

(86) PCT No.: PCT/CN2016/083085
§ 371 (c)(1),
(2) Date: Apr. 25, 2017

(87) PCT Pub. No.: WO2017/128572
PCT Pub. Date: Aug. 3, 2017

(65) Prior Publication Data

US 2018/0073316 A1 Mar. 15, 2018

(30) Foreign Application Priority Data

Jan. 29, 2016 (CN) ..... 2016 1 0067805

(51) Int. Cl.
*E21B 25/02* (2006.01)
*E21B 10/02* (2006.01)
(Continued)

(52) U.S. Cl.
CPC ..... *E21B 25/02* (2013.01); *E21B 10/02* (2013.01); *E21B 10/64* (2013.01); *E21B 25/16* (2013.01)

(58) Field of Classification Search
CPC ..... E21B 10/02; E21B 10/64; E21B 25/02; E21B 25/06
See application file for complete search history.

(56) References Cited

U.S. PATENT DOCUMENTS 2,829,868 A * 4/1958 Pickard ..... E21B 25/02 175/246
3,303,897 A * 2/1967 Casper ..... E21B 21/02 175/214
(Continued)

FOREIGN PATENT DOCUMENTS

CN 1818323 A 8/2006
CN 200992970 Y 12/2007
(Continued)

*Primary Examiner* — Nicole Coy
*Assistant Examiner* — Tara E Schimpf
(74) *Attorney, Agent, or Firm* — Gokalp Bayramoglu

(57) ABSTRACT

The present application discloses the use of the pre-stressed steel strand in, the procedure of multi-angle core drilling. Using the properties of high strength and toughness of pre-stressed steel strand material, the core internal pipe is pushed inside the drill rod without deformation and damage. The rolling wheel is designed to rapidly take out and put back the pre-stressed steel strand to finish the extracting of the core, without taking out and putting back the drill rod. Without altering the original structure of the drilling machine, the technology of 360° core drilling is realized. Problems of tedious and arduous operations and a low efficiency in multi-angle drilling are resolved completely. The use of the pre-stressed steel strand not only can significantly improve the drilling-in efficiency, but also is beneficial to guarantee the quality of the rock mineral coring, reduce the cost of drilling, lower the labor intensity notably.

1 Claim, 2 Drawing Sheets

(51) Int. Cl.
*E21B 10/64* (2006.01)
*E21B 25/16* (2006.01)

(56) References Cited

U.S. PATENT DOCUMENTS

| | | | | | |
|---|---|---|---|---|---|
| 3,784,732 | A * | 1/1974 | Whitfill, Jr. | B29C 63/00 | 174/108 |
| 5,417,122 | A * | 5/1995 | Casey | E21B 25/02 | 277/646 |
| 5,954,135 | A * | 9/1999 | Williamson | E21B 34/10 | 166/317 |
| 7,380,614 | B1 * | 6/2008 | Williamson | E21B 7/122 | 175/244 |
| 2005/0269106 | A1 * | 12/2005 | Wilson | E21B 23/14 | 166/381 |
| 2012/0305317 | A1 | 12/2012 | Ongyera | | |
| 2013/0206476 | A1 * | 8/2013 | Innes | E21B 7/124 | 175/6 |
| 2014/0000899 | A1 * | 1/2014 | Nevison | E21B 43/26 | 166/308.1 |
| 2017/0089191 | A1 * | 3/2017 | Drenth | E21B 47/00 | |

FOREIGN PATENT DOCUMENTS

| | | | |
|---|---|---|---|
| CN | 101205800 | A | 6/2008 |
| CN | 101235710 | A | 8/2008 |
| CN | 101392629 | A | 3/2009 |
| CN | 101555774 | A | 10/2009 |
| CN | 204609770 | U | 9/2015 |

* cited by examiner

USE OF PRE-STRESSED STEEL STRAND IN THE PROCEDURE OF MULTI-ANGLE DRILLING CORING

CROSS REFERENCE TO RELATED APPLICATIONS

This application is the national phase of International Application No. PCT/CN2016/083085, filed on May 24, 2016, which is based upon and claims priority to Chinese Patent Application No. 201610067805.7, filed on Jan. 29, 2016, the entire contents of which are incorporated herein by reference.

TECHNICAL FIELD

The present application relates to the field of drilling, in particular, to a pre-stressed steel strand used in 360° rapid coring in drilling, such that the properties of high strength and high toughness of the pre-stressed steel strand are used to deal with the problem that the double-pipe coring and the wire-line coring in the current multi-angle drilling industry have a low operation efficiency.

BACKGROUND

Nowadays, for the drilling equipment at home and abroad, the most ideal, the most popular, and matured coring method is the wire-line coring, i.e., using the steel wire rope. In 1947, the American Boart Longyear Company invented the technology of wire-line core drilling, which became a series of products till 1950s. In 1972, Ministry of Geology and Mineral Resources of P. R. China started researching the technology of wire-line core drilling. In the early 1980s, this technology was widespread and used domestically. Up to now, the drilling range of the wire-line coring is always used in a vertically downward angle. Since the internal pipe of the core needs to rely on its gravity to droop to the bottom of the hole, the limitation of the drilling angle cannot be exceeded. Meanwhile, the horizontal drilling and the downhole drilling have shallow hole locations and many angles. For example, for the downhole drilling, the space is narrow, and the roadway of 2×2 meters is mostly used. The wire-line coring and the tower supporting the wire-line cannot be used. Even if the technology of wire-line coring is applied, the space of the downhole needs to be enlarged, which costs time, labor, and money. Therefore, this process is generally not used.

A double-pipe coring process is used in another core drilling method. This technology was introduced from abroad in the 1950s. In order to extract the core, all drill rods need to be pulled out. After the core is retrieved, the drill rods are linked and put back into the hole. Taking out and putting back drill rods is labor intensive and time-consuming. Also, taking out drill rods will leave the hole unsupported by the drill rods, causing drilling accidents, such as collapsing, piece-dropping etc. inside the hole. When the core internal pipe is fed in, the collapsed and dropped pieces of rock may be loaded, leading to a mess of the core, self-grinding of the core, and a low sampling ratio which cannot meet the national standard. In the late 1980s, the technology of double-pipe coring is generally not used in the earth surface drilling. At present, the technology is usually used in multi-angle drilling industries, such as horizontal drilling, downhole drilling, and so on.

The pre-stressed steel strand was the construction material invented by a Frenchman, Enugene Freyssinet, in 1928. China started producing this material in the 1960s. The pre-stressed steel strand is broadly used in construction, railroad, highway, hydraulic engineering, energy, and rock anchoring construction. The pre-stressed steel strand can stand bending without cracking, expanding, and flaking off. It has nice impact property, good toughness, and can be wound circularly, and occupies a small area. When the pre-stressed steel strand is used in the technology of core drilling, cumbersome wire-line tower and high-duty pump are not required. Moreover, the downhole space does not need to be enlarged to increase the working efficiency. Therefore, it is more convenient and efficient in terms of transportation and on-site usage.

SUMMARY

The purpose of the present application is to provide the use of the pre-stressed steel strand in the procedure of multi-angle core drilling.

Technical solutions of the present application are as below:

Use of the pre-stressed steel strand in the procedure of multi-angle core drilling.

Technical problems solved by the present application are that, using the properties of high strength and toughness of pre-stressed steel strand material, the core internal pipe is pushed inside the drill rod without deformation and damage (if being horizontally pushed, the ordinary steel strand or steel wire rope will bend, and the rigidity is insufficient). The rolling wheel is designed to rapidly take out and put back the pre-stressed steel strand to finish the extracting of the core, without taking out and putting back the drill rod. Without altering the original structure of the drilling machine, the technology of 360° core drilling is realized. Problems of tedious and arduous operations and low efficiency in multi-angle drilling are resolved completely. Moreover, the structure inside the hole can be maintained. The sampling ratio of rock mineral core meets the national standard.

Advantages of the present application are as follows. 1. The rigidity of the pre-stressed steel strand is high. The pre-stressed steel strand can push the core pipe directly. The drill rod does not need to be taken out and put back to extract the core every time. Compared with the prior art, the auxiliary time of taking out and putting back the drill rod is reduced, the pure drilling-in time is increased. The deeper the drilling goes, the more significant the economic effects are. 2. The labor intensity of the worker is lowered. 3. The core jam can be cleared out immediately, such that the sampling ratio of the rock mineral core is improved. 4. The wear caused by fastening and loosening the drill rod is reduced, such that the lifetime of the drill rod is extended, and the consuming of the pipe is slowed down. 5. The wear caused by the drill hole cleaning, fastening and loosening, and collision with the wall of the hole is reduced, such that the lifetime of the drill is extended. 6. The problems caused by cleaning and sucking, and the unbalanced pressure on the wall of the hole are reduced, such that accidents inside the hole are reduced. 7. The mechanical wear caused by taking out and putting back the drill is reduced, such that the lifetime of the drilling machine is extended. 8. The curvature of the drilling hole is reduced, such that the quality of the drilling hole is improved. 9. Drilling into complex stratum is facilitated, and the wall of the hole is prevented from collapsing or dropping blocks. 10. The clinometer can be provided in the drill rod by means of pre-stressed steel strand, to measure the inclination. 11. Energy is saved. Only a small amount of power is needed to perform the operation of coring, without the running assistance of the drilling machine.

Generally, the pre-stressed steel strand coring realizes the multi-angle drilling, and can significantly improve the efficiency of the drilling-in, guarantee the quality of the rock mineral coring, reduce the cost of drilling, lower the labor intensity notably, increase the income of drilling worker, and promote the economic profit.

BR' DESCRIPTION OF THE DRAWINGS

DETAILED DESCRIPTION

Hereinafter, the usage of the present application is further described in detail.

Figure 1:
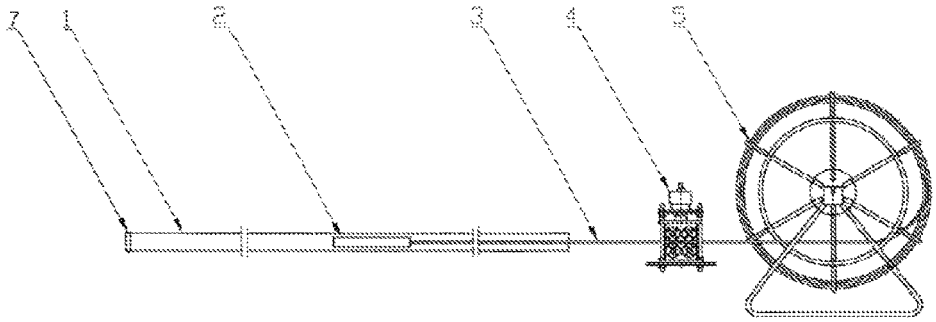
FIG. 1 is the structural schematic diagram where the present application is applied in the drilling equipment.
Figure 2:
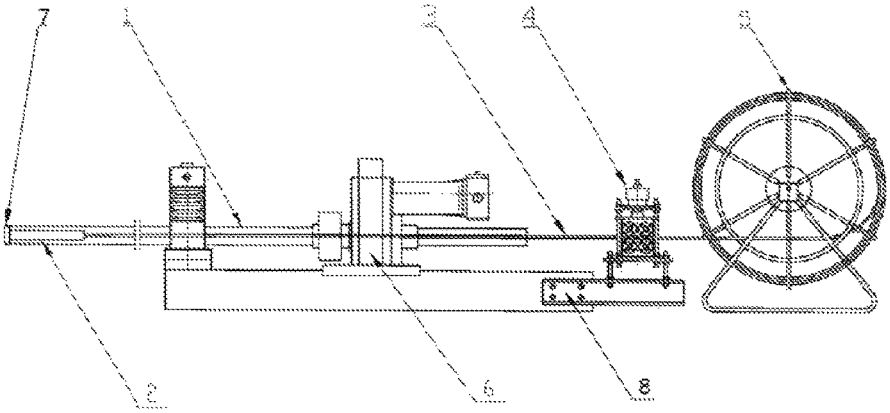
FIG. 2 is the structural schematic diagram where the present application is applied in the drilling equipment (the drilling machine added).

In FIGS. 1-2:

1. drill rod; 2. core internal pipe; 3. pre-stressed steel strand; 4. rolling wheel; 5. winder; 6. power head; 7. drill bit; 8. drill machine.

Embodiments

Operation and Equipment Conditions

Regarding the downhole horizontal drilling task, the working space has a height of 2 meters and a width of 2 meters. The power head type tunnel drilling machine 8 is used. The oil cylinder stroke is 0.75 meters. The hole depth is 300 meters. The double-pipe coring process meets the standard of the Ministry of Metallurgical Industry. The drill rod is 1.5 meters. The core internal pipe is 1.5 meters.

The Operating Method of the Double-Pipe Coring Process in the Prior Art:

1. On the above drilling field, the drilling machine 8 is set up with supports. After the safety checking is finished, the drilling machine 8 starts to run. The core internal pipe is installed to open a hole and drill into the hole.

2. After the core internal pipe is full by drilling, (In the first round trip of drilling, the drilling machine 8 clamps the core internal pipe) the effective trip of the drilling machine 8 is used to go forward and backward twice to pull out the core internal pipe. The drill bit 7 and the reamer are demounted. The core is retrieved. Next, the drill bit 7 and the reamer are mounted again. The core internal pipe is pushed forward and backward twice with the drilling machine 8 oil cylinder, so as to be fed into the hole. The drill rod is linked to go on drilling.

3. In the second round trip, the core internal pipe is fully filled. The drilling machine 8 oil cylinder is used to go forward and backward four times to pull out the drill rod and the core internal pipe. The drill bit 7 and the reamer are demounted. The core is retrieved. Next, the drill bit 7 and the reamer are mounted again. The core internal pipe is pushed forward and backward four times to be fed into the hole. The second drill rod is linked to go on drilling.

4. In the third round trip, the core internal pipe is fully filled. The drilling machine 8 oil cylinder is used to go forward and backward six times to pull out the drill rod and the core internal pipe. The drill bit 7 and the reamer are demounted. The core is retrieved. Next, the drill bit 7 and the reamer are mounted again. The core internal pipe is pushed forward and backward six times to be fed into the hole. The third drill rod is linked to go on drilling.

5. The drilling steps are performed as above; and so on. Every time the core is retrieved, all the drill rods need to be taken out. If 200 drill rods are to be taken out, 800 times of operation of taking-out, 400 times of mounting and demounting of the drill rods are required. Each round trip can be finished within about 110 minutes.

Operation Method of Pre-Stressed Steel Strand Coring Process of the Present Application:

1. Under equal conditions, the pre-stressed steel strand coring process is used. On the field, the drilling machine 8 is set up with supports. After the safety checking is finished, the drilling machine 8 starts to run. Core internal pipe 2 is installed to open a hole and drill into the hole. (Two core internal pipes are prepared on site.)

2. After the core internal pipe 2 is full by drilling, the pre-stressed steel strand coring overshot is conveyed by rolling wheel 4, and enters the drill rod to obtain core internal pipe 2. Core internal pipe 2 is rapidly pulled out and put down. Next, an empty core internal pipe is taken. The core internal pipe is pushed rapidly by the pre-stressed steel strand pusher driven by the rolling wheel. The core internal pipe is clamped. Pre-stressed steel strand 3 is pulled out. Drill rod 1 is linked to go on drilling.

3. When the drilling machine 8 is drilling, the core is retrieved, which increases the drilling-in time.

4. In the second round trip, when the core internal pipe is full, the drill rod does not need to be taken out. The pre-stressed steel strand coring overshot is conveyed by rolling wheel 4, and enters the drill rod to obtain the core internal pipe. The core internal pipe is rapidly pulled out and put down. Next, an empty core internal pipe is taken. The core internal pipe is pushed rapidly by the pre-stressed steel strand pusher driven by the rolling wheel. The core internal pipe is clamped. The pre-stressed steel strand is pulled out. The drill rod is linked to go on drilling.

5. When the drilling machine 8 is drilling, the core is retrieved.

6. In the third round trip, when the core internal pipe is full, the drill rod does not need to be taken out. The pre-stressed steel strand coring overshot is conveyed by the rolling wheel, and enters the drill rod to obtain the core internal pipe. The core internal pipe is rapidly pulled out and put down. Next, an empty core internal pipe is taken. The core internal pipe is pushed rapidly by the pre-stressed steel strand pusher driven by the rolling wheel. The core internal pipe is clamped. Pre-stressed steel strand is pulled out. The drill rod is linked to go on drilling.

7. When the drilling machine 8 is drilling, the core is retrieved.

Figure 3:
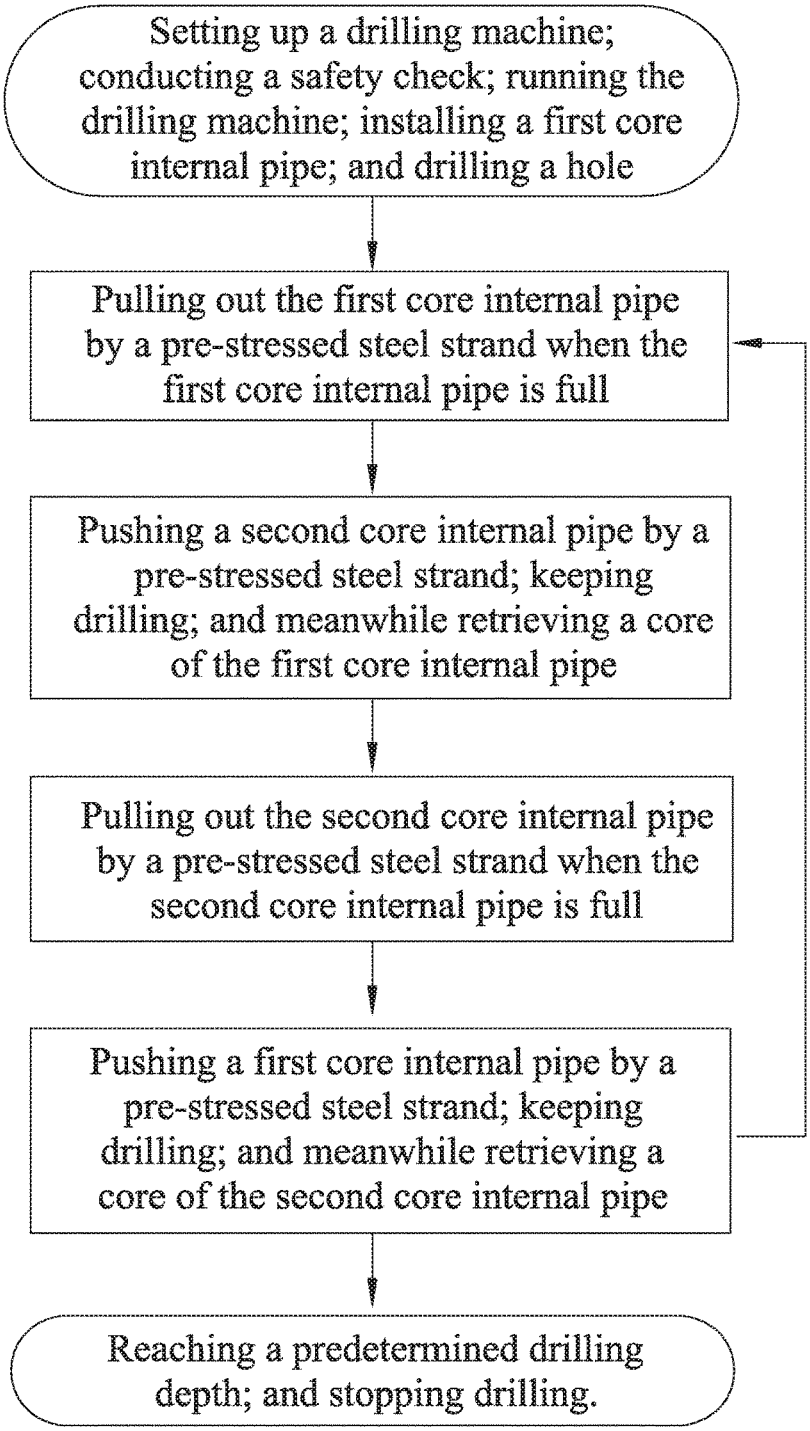
FIG. 3 is the flow chart of the present invention.

8. The above steps are repeated, such that the core can be extracted without taking out the drill rods, as shown in FIG. 3.

With the pre-stressed steel strand coring process, under equal conditions, it is not necessary to take out 200 drill rods. The pre-stressed steel strand can take out and put back the core internal pipe within about 20 minutes to finish one round trip. The efficiency of the pre-stressed steel strand coring process is 5.5 times as that of the double-pipe coring process.

If a drilling task of 300 meters tunnel horizontal hole is to be completed, under equal conditions, the double-pipe coring method in the prior art requires the operator to conduct 80400 times of pulling and pushing operation, and 40200 times of mounting and demounting of the drill rods, loosening and fastening the drill rods and the drill thread actions, so as to retrieve the core. If the pre-stressed steel strand coring of the present application is used, under equal conditions, the drill rods do not need to be taken out. Merely 400 times of pulling and pushing of the core internal pipe are needed to retrieve the core (during which all the drill rods need to be taken out if the drill bit is replaced, and 1200 times of operations are counted for replacing three drill bits). Only 1600 times of pulling and pushing actions in total are needed to complete the task. The labor intensity of the operator is lowered, and 50 times of labor work can be saved.

In 2015, the present application is applied in the multi-angle drilling on site for a long time. For a dozen hours of experiment every day, it is proved that the pre-stressed steel strand coring does not cause any abnormal condition, sticking of the drill, drilling without reaching the bottom of the hole, and broken pre-stressed steel strand situation. The pre-stressed steel strand coring shows good stability, and can meet the requirements on site to reach the ideal status of the pre-stressed steel strand coring. Without altering the original structure of the drilling machine, a small amount of investment is required to realize the multi-angle drilling.

What is claimed is:

1. A method for multi-angle core drilling using pre-stressed steel strand, comprising:

A setting up a drilling machine with support on a drilling field; conducting a safety check; running the drilling machine; installing a first core internal pipe; drilling a hole;

B conveying a pre-stressed steel strand by a rolling wheel after the first core internal pipe is full with a core by drilling; wherein the pre-stressed steel strand enters a front part of a drill rod to obtain the core internal pipe; pulling out the first core internal pipe without taking out the drill rod; putting down the first core internal pipe;

C putting a second core internal pipe in the drill rod; pushing the second core internal pipe by the pre-stressed steel strand which is driven by the rolling wheel, such that the second core internal pipe is pushed into a front end of the drill rod; pulling out the pre-stressed steel strand; winding the pre-stressed steel strand on a winder; linking the drill rod; running a power head; keeping drilling; wherein the second core internal pipe is empty before drilling;

D when the drilling machine is drilling with the second core internal pipe, retrieving a core of the first core internal pipe; and when the drilling machine is drilling with the first core internal pipe, retrieving a core of the second core internal pipe;

E repeating the steps B, C, and D, till a predetermined drilling depth is reached.

* * * * *